United States Patent [19]

Ogiso et al.

[11] Patent Number: 5,057,341

[45] Date of Patent: Oct. 15, 1991

[54] METHOD OF PROCESSING CARBON FIBER PRECURSOR FROM PITCHY MATERIALS

[75] Inventors: Osamu Ogiso; Hideto Uchida, both of Aichi, Japan

[73] Assignee: Takemoto Yushi Kabushiki Kaisha, Aichi, Japan

[21] Appl. No.: 309,297

[22] Filed: Feb. 10, 1989

[30] Foreign Application Priority Data

Feb. 24, 1988 [JP] Japan ..... 63-41671
Feb. 24, 1988 [JP] Japan ..... 63-41672

[51] Int. Cl.[5] ..... B05D 3/02; B27B 17/00; D01F 9/12; B32B 9/00

[52] U.S. Cl. ..... 427/387; 264/130; 264/29.2; 264/29.5; 428/375; 428/391; 428/408; 423/447.1; 252/34; 252/49.5; 252/49.6; 252/51.5 R; 252/52 A

[58] Field of Search ..... 264/29.2, 29.5, 130; 423/447.1; 252/309; 428/367, 391, 408; 427/387

[56] References Cited

U.S. PATENT DOCUMENTS

| | | | |
|---|---|---|---|
| 4,349,523 | 9/1982 | Hiramatsu et al. | 264/29.2 |
| 4,496,631 | 1/1985 | Adachi et al. | 264/29.2 |
| 4,582,662 | 4/1986 | Koga et al. | 264/130 |
| 4,603,042 | 7/1986 | Setsuie et al. | 264/29.2 |
| 4,626,289 | 12/1986 | Hsu | 428/391 |
| 4,857,212 | 8/1989 | Ona et al. | 428/391 |
| 4,895,712 | 1/1990 | Komine et al. | 264/29.2 |
| 4,902,739 | 2/1990 | Ona et al. | 428/391 |
| 4,923,692 | 5/1990 | Nakagoshi et al. | 264/29.2 |
| 4,931,233 | 6/1990 | Miyahara et al. | 264/130 |

FOREIGN PATENT DOCUMENTS

| | | |
|---|---|---|
| 62-133120 | 6/1987 | Japan . |
| 62-177220 | 8/1987 | Japan . |

*Primary Examiner*—George F. Lesmes
*Assistant Examiner*—James D. Withers
*Attorney, Agent, or Firm*—Heller, Ehrman, White & Mcauliffe

[57] ABSTRACT

Carbon fiber precursors from pitchy materials are processed by applying thereonto an aqueous emulsion containing a single silicone oil or a mixture of silicone oils selected from polydimethyl siloxane, phenyl modified polydimethyl siloxane and aminoalkyl modified polydimethyl siloxane and having kinetic viscosity at 25° C. of 100 centistokes or less, an alkanolamine salt of aliphatic monocarboxylic acid with 8–18 carbon atoms, and one or more non-ionic surfactants selected from polyoxyethylene alkylphenylethers polyoxyethylene alkylates, polyoxyethylene alkylaminoethers, and aliphatic monocarboxylic alkanolamides such that 0.1–5 wt % by solid deposit on fiber from this aqueous emulsion apply to the pitch fibers during any of the processes from the spinning and to the oxidizing.

4 Claims, No Drawings

METHOD OF PROCESSING CARBON FIBER PRECURSOR FROM PITCHY MATERIALS

BACKGROUND OF THE INVENTION

This invention relates to methods of processing carbon fibers from pitchy materials.

Carbon fibers from pitchy materials or acrylic filaments are widely being used for improving the strength, modulus of elasticity and other characteristics of composites used in aerospace, leisure, sports and other industries. Since carbon fibers are basically very brittle, however, a finish is generally used in their production in order to improve cohesion of the fibers and their processability from the spinning process and to the oxidizing process.

Recently, in view of the increased demands for improvement in the characteristics of composites, higher requirements are also being imposed on the characteristics of carbon fibers which are used for these composites. As a result, there are also increased demands for a finish with superior characteristics because the characteristics of carbon fibers are strongly dependent on the finish which is used. The present invention, therefore, relates to a method of processing carbon fiber precursor from pitchy materials with which the above demands can be satisfied.

For the production of carbon fibers, it has been known to cause silicone compounds as components of a finish having characteristics such as anti-adhesion of fibers, yarn bundle cohesion and lubricity to adhere to precursor fibers before an oxidation process (as disclosed, for example, in Japanese Patent Publication Tokko 38-12375, U.S. Pat. No. 3,656,903, Japanese Patent Publication Tokkai 49-117724 and Japanese Patent Publication Tokkai 59-223315). Almost all of them that are practically effective are hydrophobic silicone compounds, and these hydrophobic silicone compounds are accordingly used either as a solution with an organic solvent or as an aqueous emulsion.

By a method of processing with a solution having an organic solvent, however, there are always problems such as fusion because organic solvents tend to melt precursor fibers although there are differences in degree. Other problems include the danger of flammability and explosion.

Methods of processing by using an aqueous emulsion are superior, on the other hand, from the points of view of workability and safety and there have been many proposals regarding the type of emulsifier to be used, its ratio, etc. as disclosed, for example, in Japanese Patent Publication Tokkai 60-181322, U.S. Pat. No. 4,603,042, European Patent 175,200 and Japanese Patent Publication Tokkai 62-156316. There are problems with the prior art finishes described above for processing as an aqueous emulsion, however, because they cannot completely satisfy the stringent modern requirements imposed on them from the points of view of production of a stable silicone emulsion, uniform application of such an emulsion onto fibers and, in particular, prevention of adhesion among fibers.

SUMMARY OF THE INVENTION

It is therefore an object of the present invention to provide an improved method of processing carbon fiber precursor from pitchy materials with which the problems of prior art methods can be eliminated.

The present invention has been completed by the present inventors as a result of their diligent studies in view of the aforementioned object and is based on their following significant observations. Firstly, if a prior art silicone emulsion is used on carbon fiber precursor from pitchy materials, the emulsifier for emulsifying silicone has significantly adverse effects on the superior anti-adhesion characteristic of silicone which is the main constituent although the emulsifier is only a secondary constituent. Secondly, although oiling rollers and guides used for applying a silicone emulsion to fibers from pitchy materials are normally made of a metallic or ceramic material, prior art silicone emulsions do not have a good wetting characteristic with respect to such materials, or they may wet reasonably well in the beginning but become water-repellant as time passes. This serves as a big obstacle to uniform application of the silicone emulsion. Thirdly, although examples of an emulsifier used for a prior art silicone emulsion include polyoxyethylene alkylphenylethers, polyoxyethylene alkylethers, polyoxyethylene alkylesters, sorbitan alkylesters, polyoxyethylene sorbitan alkylesters, polyoxyethylene lanolin derivatives, alkyl sulfate esters, and dialkyl sulfosuccinates, fusion takes place easily among carbon fibers from pitchy materials when heated to 200°-300° C. if an emulsifier of a polyoxyalkylene adduct type is used singly with respect to silicone and the emulsifier itself produces a significant amount of tar when heated to 200°-300° C. if an emulsifier of sorbitan alklyester, alkyl sulfate ester or dialkyl sulfosuccinate is used. In other words, the problem of fusion remains serious for carbon fibers from pitchy materials.

As a result of further studies, the present inventors have completed the present invention by discovering a method of processing carbon fiber precursor from pitchy materials by using an aqueous emulsion having silicone oil of a specified kind as its principal component together with two other specified components as an indispensable emulsifier.

DETAILED DESCRIPTION OF THE INVENTION

This invention relates to a method of processing carbon fiber precursor from pitchy materials by applying to the fibers an aqueous emulsion containing a silicone oil of Type A described below, an alkanolamine salt of Type B described below and one or more non-ionic surfactants selected from Group C described below such that 0.1-5 wt% by solid deposit of this aqueous emulsion apply to the pitch fibers during any of the processes from the spinning process and to the oxidizing process, Type A being a single silicone oil or a mixture of silicone oils selected from polydimethyl siloxane, phenyl modified polydimethyl siloxane and aminoalkyl modified polydimethyl siloxane and having kinetic viscosity at 25° C. of 100 centistokes or less; Type B being an alkanolamine salt of aliphatic monocarboxylic acid with 8-18 carbon atoms; and Group C consisting of (1) polyoxyethylene alkylphenylethers, (2) polyoxyethylene alkylates, (3) polyoxyethylene alkylaminoethers, and (4) aliphatic monocarboxylic alkanolamides.

The carbon fibers from pitchy materials to which the method of the present invention relates are those which can be produced by melting and spinning pitch such as coal pitch obtainable during a coke production process or petroleum pitch obtainable during an oil refining process.

The silicone oil which serves as the principal component of an aqueous emulsion to be used according to the present invention is a hydrophobic silicone with kinetic viscosity at 25° C. (hereinafter merely referred to as kinetic viscosity) of 100 centistokes or less. Particularly preferable examples of such silicone oil include polydimethyl siloxane, phenyl modified polydimethyl siloxane and aminoalkyl modified polydimethyl siloxane. If the kinetic viscosity exceeds 100 centistokes, it is difficult to obtain an aqueous emulsion which can remain stable for a long period of time.

The aliphatic monocarboxylic acid, from which an alkanolamine salt of aliphatic monocarboxylic acid for a method of the present invention is produced, has 8–18 carbon atoms without regard to whether it is natural or synthetic, whether it is saturated or unsaturated and whether it is a straight chain or has a side chain but those with 8–10 carbon atoms are particularly preferable. If the number of carbon atoms is less than 8 or exceeds 18, the stability and wetting characteristics of the produced aqueous emulsion are adversely affected.

Examples of alkanolamine which serves as counter ion of such aliphatic monocarboxylic acid include monoethanolamine, diethanolamine, triethanolamine, monoisopropanolamine, diisopropanolamine, triisopropanolamine, butyldiethanolamine, dibutylethanolamine and aminoethyl ethanolamine.

Polyoxyethylene alkylphenylether of a method according to the present invention is obtained by adding ethylene oxide to alkylphenol with or without a side chain. Examples of alkylphenol include octylphenol, nonylphenol, dodecylphenol and dinonylphenol. Those with 1–50 mol of ethylene oxide added to 1 mol of such alkylphenol are preferable. Particularly preferable are those obtainable by adding 3–20 mol of ethylene oxide.

Polyoxyethylene alkylates related to a method according to the present invention include those obtainable by adding ethylene oxide to aliphatic monocarboxylic acid or by an esterification reaction of polyethylene glycol and aliphatic monocarboxylic acid. Preferable among them are those obtainable by adding 1–50 mol of ethylene oxide to 1 mol of aliphatic monocarboxylic acid with or without a side chain and having 8–18 carbon atoms. Those obtainable by adding 3–20 mol of ethylene oxide and those obtainable by esterification reaction of 1 mol of polyethyleneglycol of average molecular weight about 200–1000 and 1–2 mol of aforementioned aliphatic monocarboxylic acid are particularly preferable. For this purpose, octanoic acid, decanoic acid and lauric acid can be used as an example of aliphatic monocarboxylic acid.

Polyoxyethylene alkylaminoethers related to a method according to the present invention are obtainable by adding ethylene oxide to alkylamine. Preferable among them are those obtainable by adding 1–50 mol of ethylene oxide to 1 mol of primary or secondary alkylamine with an aliphatic hydrocarbon group with or without a side chain and with 8–18 carbon atoms connected to a nitrogen atom. Those obtainable by adding 3–20 mol are particularly preferable.

Aliphatic monocarboxylic alkanolamides related to a method according to the present invention are preferably those, without regard to whether they are natural or synthetic, whether they are saturated or unsaturated, and whether they are a straight chain or have a side chain, obtainable by a reaction between an aliphatic monocarboxylic acid with 8–18 carbon atoms or its lower alkylester and one or more, for example, from monoethanolamine, diethanolamine, monoisopropanolamine and diisopropanolamine at a molar ratio of 1/1–1/2.

An aqueous emulsion according to a method of the present invention can be obtained stably by mixing a silicone oil described above as Type A, an alkanolamine salt of aliphatic monocarboxylic acid described above as Type B and one or more non-ionic surfactants selected from what was described above as Group C, adding water at ordinary temperature to it gradually to produce a coarse emulsion and supplying it to a homogenizer. In this connection, the ratio of mixture by weight should preferably be A/B/C=95–70/1–20/1–20. With the mixing ratio selected within the range given above, an even more stable aqueous emulsion with improved anti-adhesion characteristic can be obtained. Such an aqueous emulsion can be prepared at a concentration within a range of 0.1–65 wt% but it is usually prepared within a range of 5–65 wt%. In actual applications, an aqueous emulsion diluted to 0.1–20 wt% is applied by a kiss roll method or a metering method to carbon fiber precursor from pitchy materials immediately after it is melted and spun such that 0.1–5 wt% as solid components adheres, or more preferably 0.5–2 wt%. If necessary, an emulsifier, an antistat, an anti-rust agent and an antiseptic of known kinds may be used additionally.

In what follows, the present invention is described by way of examples but these examples are not intended to limit the scope of the present invention.

Test 1

Into a mixture with 30 weight parts (hereinafter abbreviated simply into "parts") of polydimethyl siloxane with kinetic viscosity of 10 centistokes, 4 parts of decanoic acid diethanol amine salt and 3 parts of polyoxyethylene (6 mol) nonylphenylether, 63 parts of water were gradually added with stirring to obtain a coarse emulsion from which a stable 37-wt% aqueous emulsion (Sample 1) was obtained by means of a homogenizer. Similarly, polyoxyethylene (5 mol) laurate was used instead of polyoxyethylene (6 mol) nonylphenylether to obtain another aqueous emulsion (Sample 2), polyoxyethylene (6 mol) laurylaminoether was used to obtain still another aqueous emulsion (Sample 3), and coco-fatty acid diisopropanolamide was used to obtain still another aqueous emulsion (Sample 4). Each aqueous emulsion (18kg) was placed inside a 20-liter container and left quietly for 6 months at 20° C. but no creaming or separation phenomena were observed in any of the emulsions. Table 1 shows the granular size of each aqueous emulsion measured by a centrifugal precipitation method.

TABLE 1

| Time of Measurement | Granular Diameter (micron) | | | |
|---|---|---|---|---|
| | Sample 1 | Sample 2 | Sample 3 | Sample 4 |
| Immediately after | 0.35 | 0.39 | 0.35 | 0.42 |
| After 1 day | 0.35 | 0.39 | 0.35 | 0.43 |
| After 1 mo. | 0.36 | 0.40 | 0.35 | 0.43 |
| After 3 mos. | 0.36 | 0.41 | 0.36 | 0.45 |
| After 6 mos. | 0.37 | 0.42 | 0.36 | 0.45 |

Test 2

Aqueous emulsions shown in Table 2 (Samples 5–8 and Comparison Samples 1–3) were prepared as described above in connection with Test 1 and their wetting characteristics were evaluated by filling an oiling apparatus having a ceramic roller with each of these sample emulsions such that a part of the roller becomes submerged, leaving the roller rotating and observing the water-repellant characteristics on the roller surface over a time period. The results of observations are shown in Table 3.

TABLE 2

| Component | Samples 5 | 6 | 7 | 8 | 9 | Comparisons 1 | 2 | 3 |
|---|---|---|---|---|---|---|---|---|
| (a) | 9 | 9 | 9 | 9 | 9 | 9 | 9 | 9 |
| (b) | 0.5 | 0.5 | 0.5 | | | | | |
| (c) | | | | 0.5 | 1 | | | |
| (d) | 0.5 | | | | | 1 | | |
| (e) | | 0.5 | | | | | 1 | |
| (f) | | | 0.5 | | | | | 1 |
| (g) | | | | 0.5 | 1 | | | |
| (h) | 90 | 90 | 90 | 90 | 90 | 90 | 90 | 90 |

Notes:
(a) Polydimethyl siloxane (kinetic viscosity = 20 cst)
(b) Octanoic acid triiospropanolamine salt
(c) Decanoic acid triiospropanolamine salt
(d) Polyoxiethylene (8 mol) nonylphenylether
(e) Polyethylene glycol (MW 400) monolaurate
(f) Polyoxyethylene (10 mol) laurylaminoether
(g) Cocofatty acid diethanolamide
(h) Water

TABLE 3

| Time of Observation | Samples 5 | 6 | 7 | 8 | 9 | Comparisons 1 | 2 | 3 |
|---|---|---|---|---|---|---|---|---|
| Immediately after | A | A | A | A | A | A | A | A |
| After 4 hrs. | A | A | A | A | A | A | B | B |
| After 8 hrs. | A | A | A | A | A | B | C | C |
| After 16 hrs. | A | A | A | A | A | B | C | C |
| After 24 hrs. | A | A | A | A | A | C | C | C |

where
A: No water-repelling
B: Water-repelling slightly present
C: Water-repelling present

Test 3

Aqueous emulsions shown in Table 4 (Samples 10–19 and Comparison Samples 4–6) were prepared as described above in connection with Test 1. Their wetting characteristics were evaluated by the same method as described above and the anti-adhesion characteristics of oxidized fibers from pitch fibers processed with them were evaluated as follows by using an oiling apparatus having a ceramic roller and processing 500-filament bundles of pitch fibers such that 1.5 wt% as solid deposit on fiber of each aqueous emulsion is applied. These filaments were cut to obtain chopped strands with fiber length of 2cm. After they were placed on a metallic net and dried overnight naturally in an atmosphere of 25° C. and 65%RH, they were subjected to a heat treatment inside a hot-air oven at 250° C. for one hour. After the heat treatment, the bundles were moved onto a filter paper sheet and their filament separation was obserbed as they were manually defibered. Table 5 shows the results of evaluation according to the following standards:

A: Separated nearly into individual fiber

B: Extremely small number of unseparated units of a few adhering fibers but others were separated into individual fiber C: Many unseparated units of several tens of adhering fiber and only a few separated into individual fiber D: Mostly adhering in units of more than several tens of fibers or as original bundle and none separated into individual fiber

TABLE 4

| Component | Samples 10 | 11 | 12 | 13 | 14 | 15 | 16 | 17 | 18 | 19 | Comparisons 4 | 5 | 6 |
|---|---|---|---|---|---|---|---|---|---|---|---|---|---|
| A-1 | 6 | 6 | 6 | 6 | 6 | 6 | 6 | 6 | 6 | 5 | 6 | 6 | 6 |
| A-2 | 2 | 2 | 2 | 2 | 2 | 2 | 2 | 2 | 2 | 2 | 2 | 2 | 2 |
| B-1 | 1 | | | | | | | | | | | | |
| B-2 | | 1 | | | | | | | | | | | |
| B-3 | | | 1 | | | | | | | | | | |
| B-4 | | | | 1 | | | | | | 1.5 | | | |
| B-5 | | | | | 1 | | | | | | | | |
| B-6 | | | | | | 1 | 1.5 | | | | | | |
| B-7 | | | | | | | | | | | 1 | | |
| B-8 | | | | | | | | | | | | 1 | |
| C-1 | 1 | 1 | 1 | 1 | 1 | 1 | 0.5 | | | 1.5 | 1 | 1 | 1 |
| C-2 | | | | | | | | 1 | | | | | |
| C-3 | | | | | | | | | 1 | | | | |
| C-4 | | | | | | | | | | | | | 1 |
| Water | 90 | 90 | 90 | 90 | 90 | 90 | 90 | 90 | 90 | 90 | 90 | 90 | 90 |

Notes:
A-1: Polydimethyl siloxane (kinetic viscosity = 10 cst)
A-2: Phenyl modified polydimethyl siloxane (kinetic viscosity = 100 cst)
B-1: Isopalmitic acid triisopropanolamine salt
B-2: Decanoic acid triisopropanolamine salt
B-3: Octanoic acid triisopropanolamine salt
B-4: Octanoic acid diethanolamine salt
B-5: Octanoic acid monoethanolamine salt
B-6: Octanoic acid aminoethylethanolamine salt
B-7: Erucic acid triisopropanolamine salt
B-8: Hexanoic acid triisopropanolamine salt
C-1: Polyoxyethylene (7 mol) nonylphenylether
C-2: Polyoxyethylene (7 mol) oleate
C-3: Polyoxyethylene (7 mol) cocofatty amine
C-4: Sorbitan monolaurate

TABLE 5

| Wetting | 10 | 11 | 12 | 13 | 14 | 15 | 16 | 17 | 18 | 19 | 4 | 5 | 6 |
|---|---|---|---|---|---|---|---|---|---|---|---|---|---|
| Immediately after | A | A | A | A | A | A | A | A | A | A | A | B | A |
| After 4 hrs. | A | A | A | A | A | A | A | A | A | A | A | C | A |
| After 8 hrs. | A | A | A | A | A | A | A | A | A | A | B | C | B |
| After 16 hrs. | A | A | A | A | A | A | A | A | A | A | C | C | C |
| After 24 hrs. | A | A | A | A | A | A | A | A | A | A | C | C | C |
| Anti-adhesion | B | A | A | A | A | A | A | B | B | B | C | C | D |

Test 4

Aqueous emulsions shown in Table 6 (Samples 20–25 and Comparison Samples 7–9) were prepared as described above in connection with Test 1. Their wetting and anti-adhesion characteristics were evaluated by the same method as described above. The results of evaluation are shown in Table 7.

TABLE 6

| Component | Samples 20 | 21 | 22 | 23 | 24 | 25 | Comparisons 7 | 8 | 9 |
|---|---|---|---|---|---|---|---|---|---|
| A-3 | 8.5 | | | | | | | | |
| A-4 | | 8.5 | | | | | | 8.5 | 8.5 |
| A-5 | | | 8.5 | | 8.5 | 8.5 | | | |
| A-6 | | | | 8.5 | | | | | |
| A-7 | | | | | | | 8.5 | | |
| B-5 | 1.0 | 1.0 | 1.0 | 0.5 | 0.5 | 0.5 | 0.5 | | 1.5 |
| C-5 | 0.5 | 0.5 | 0.5 | 1.0 | | | 1.0 | | |
| C-6 | | | | | 1.0 | | | 1.5 | |
| C-7 | | | | | | 1.0 | | | |

TABLE 6-continued

| Component | Samples 20 | 21 | 22 | 23 | 24 | 25 | Comparisons 7 | 8 | 9 |
|---|---|---|---|---|---|---|---|---|---|
| Water | 90 | 90 | 90 | 90 | 90 | 90 | 90 | 90 | 90 |

Notes:

A-3: Polydimethyl siloxane (kinetic viscosity = 5 cst)

A-4: Mixed polydimethyl siloxane (kinetic viscosity = 15 cst = 10 cst + 1000 sct)

A-5: Phenyl modified polydimethyl siloxane (kinetic viscosity = 20 cst)

A-6: Aminoethyl aminopropyl modified polydimethyl siloxane (kinetic viscosity = 80 cst)

A-7: Polydimethyl siloxane (kinetic viscosity = 200 cst)

B-5: Octanoic acid monoethanolamine salt

C-5: Polyoxyethylene (10 mol) dodecylphenylether

C-6: Polyoxyethylene (9 mol) laurate

C-7: Polyoxyethylene (10 mol) laurylaminoether

TABLE 7

| | Samples 20 | 21 | 22 | 23 | 24 | 25 | Comparisons 7 | 8 | 9 |
|---|---|---|---|---|---|---|---|---|---|
| Immediately after | A | A | A | A | A | A | B | A | A |
| After 4 hrs. | A | A | A | A | A | A | C | A | C |
| After 8 hrs. | A | A | A | A | A | A | C | B | C |
| After 16 hrs. | A | A | A | A | A | A | C | C | C |
| After 24 hrs. | A | A | A | A | A | A | C | C | C |
| Anti-adhesion | A | A | A | B | B | B | C | D | C |

Test 5

Aqueous emulsions shown in Table 8 (Samples 26–34 and Comparison Samples 10–13) were prepared as described above in connection with Test 1. Their wetting and anti-adhesion characteristics were evaluated by the same method as described above. The results of evaluation are shown in Table 9.

TABLE 8

| Component | Samples 26 | 27 | 28 | 29 | 30 | 31 | 32 | 33 | 34 | Comparisons 10 | 11 | 12 | 13 |
|---|---|---|---|---|---|---|---|---|---|---|---|---|---|
| A-1 | 6 | 6 | 6 | 6 | 6 | 6 | 6 | 6 | 4 | 6 | 6 | 6 | 6 |
| A-2 | 2 | 2 | 2 | 2 | 2 | 2 | 2 | 2 | 2 | 2 | 2 | 2 | 2 |
| B-1 | 1 | | | | | | | | | | | | |
| B-2 | | 1 | | | | | | | | | | | |
| B-3 | | | 1 | | | | | | | | | | |
| B-4 | | | | 1 | 1.5 | | | | 2 | | | | 1 |
| B-5 | | | | | | 1 | | | | | | | |
| B-7 | | | | | | | | | | | 1 | | |
| B-8 | | | | | | | | | | | | 1 | |
| B-9 | | | | | | | 1 | | | | | | |
| B-10 | | | | | | | | 1 | | | | | |
| C-4 | | | | | | | | | | | | | 1 |
| C-8 | | | | | | 1 | 1 | 1 | 2 | | 1 | 1 | |
| C-9 | 1 | 1 | 1 | 1 | 0.5 | | | | | | | | |
| C-10 | | | | | | | | | | 2 | | | |

TABLE 8-continued

| Component | Samples 26 | 27 | 28 | 29 | 30 | 31 | 32 | 33 | 34 | Comparisons 10 | 11 | 12 | 13 |
|---|---|---|---|---|---|---|---|---|---|---|---|---|---|
| Water | 90 | 90 | 90 | 90 | 90 | 90 | 90 | 90 | 90 | 90 | 90 | 90 | 90 |

Notes:
A-1: Polydimethyl siloxane (kinetic viscosity = 10 cst)
A-2: Phenyl modified polydimethyl siloxane (kinetic viscosity = 100 cst)
B-1: Isopalmitic acid triisopropanolamine salt
B-2: Decanoic acid triisopropanolamine salt
B-3: Octanoic acid triisopropanolamine salt
B-4: Octanoic acid diethanolamine salt
B-5: Octanoic acid monoethanolamine salt
B-7: Erucic acid triisopropanolamine salt
B-8: Hexanoic acid triisopropanolamine salt
B-9: Octanoic acid dibutylethanolamine salt
B-10: Octanoic acid aminoethylethanolamine salt
C-4: Sorbitan monolaurate
C-8: Cocofatty acid diethanolamide (reaction molar ratio between cocofatty acid and diethanolamine = 1/1)
C-9: Cocofatty acid diethanolamide (reaction molar ratio between cocofatty acid and diethanolamine = 1/2)
C-10: Polyoxyethylene (6 mol) nonyl phenylether

TABLE 9

| | Samples 26 | 27 | 28 | 29 | 30 | 31 | 32 | 33 | 34 | Comparisons 10 | 11 | 12 | 13 |
|---|---|---|---|---|---|---|---|---|---|---|---|---|---|
| Immediately after | A | A | A | A | A | A | A | A | A | A | A | A | A |
| After 4 hrs. | A | A | A | A | A | A | A | A | A | A | B | B | A |
| After 8 hrs. | A | A | A | A | A | A | A | A | A | B | C | C | A |
| After 16 hrs. | A | A | A | A | A | A | A | A | A | C | C | C | B |
| After 24 hrs. | A | A | A | A | A | A | A | A | A | C | C | C | C |
| Anti-adhesion | A | A | A | A | A | A | A | A | B | D | C | C | C |

The results shown above in the tables clearly demonstrate that not only are the aqueous emulsions of the present invention stable over a long period of time and free from dangers of fire and explosion but their workability is extremely high. Since they stably exhibit superior wetting characteristics for a long time, they can uniformly apply to carbon fiber precursor from pitchy materials for a long time. The present invention is particularly advantageous in that superior anti-adhesion characteristics can be provided to carbon fibers from pitchy materials.

What is claimed is:

1. A method of processing carbon fiber precursor from pitchy materials, said method comprising the step of applying to fibers from pitchy materials an aqueous emulsion containing a first component which is a single silicone oil or a mixture of silicone oils selected from polydimethyl siloxane, phenyl modified polydimethyl siloxane and aminoalkyl modified polydimethyl siloxane and having kinetic viscosity at 25° C. of 100 centistokes or less, a second component which is an alkanol amine salt of aliphatic monocarboxylic acid with 8–18 carbon atoms, and a third component which is one or more selected from the group of non-ionic surfactants consisting of polyoxyethylene alkylphenylethers, polyoxyethylene alkylates, polyoxyethylene alkylaminoethers, and aliphatic monocarboxylic alkanolamides such that 0.1–5 wt% by solid deposit of said aqueous emulsion apply to said fibers during any of processes from a spinning process and to an oxidizing process.

2. The method of claim 1 wherein the weight ratio of said first, second and third components in said aqueous emulsion is 95–70/1–20/1–20.

3. The method of claim 1 wherein said alkanolamine salt of said second component is obtainable from aliphatic monocarboxylic acid with 8–10 carbon atoms.

4. The method of claim 2 wherein said alkanolamine salt of said second component is obtainable from aliphatic monocarboxylic acid with 8–10 carbon atoms.

* * * * *